US009149703B2

(12) United States Patent
Partlo

(10) Patent No.: US 9,149,703 B2
(45) Date of Patent: Oct. 6, 2015

(54) MULTI-MOUNT HEAVY BAG WITH: SCULPTED BODY SIDE, EXTENDED HEAD LIKE APPENDAGE, CONTOURS AND DEVELOPED STRIKING AREAS

(71) Applicant: Loren George Partlo, Coleman, MI (US)

(72) Inventor: Loren George Partlo, Coleman, MI (US)

(73) Assignee: Loren G. Partlo

( * ) Notice: Subject to any disclaimer, the term of this patent is extended or adjusted under 35 U.S.C. 154(b) by 0 days.

(21) Appl. No.: 13/940,686

(22) Filed: Jul. 12, 2013

(65) Prior Publication Data

US 2015/0018174 A1 Jan. 15, 2015

(51) Int. Cl.

| | |
|---|---|
| ***A63B 69/34*** | (2006.01) |
| ***A63B 69/20*** | (2006.01) |
| ***A63B 71/06*** | (2006.01) |
| *A63B 71/02* | (2006.01) |

(52) U.S. Cl.

CPC ..... *A63B 69/201* (2013.01); *A63B 69/34* (2013.01); *A63B 71/0622* (2013.01); *A63B 2071/024* (2013.01); *A63B 2071/026* (2013.01); *A63B 2071/0625* (2013.01); *A63B 2071/0658* (2013.01); *A63B 2220/53* (2013.01); *A63B 2225/15* (2013.01); *A63B 2225/50* (2013.01); *A63B 2244/102* (2013.01)

(58) Field of Classification Search

CPC .. A63B 69/201; A63B 69/34; A63B 71/0622; A63B 2071/024; A63B 2071/026; A63B 2071/0625; A63B 2071/0658

USPC ..... 482/1–9, 83–90, 900–902; 434/247, 434/256; 273/440.1; 473/441–445

See application file for complete search history.

(56) References Cited

U.S. PATENT DOCUMENTS

| | | | | |
|---|---|---|---|---|
| 2,994,534 | A * | 8/1961 | Davis et al. | 473/444 |
| 4,088,315 | A * | 5/1978 | Schemmel | 482/4 |
| 4,546,996 | A * | 10/1985 | Hanson | 280/764.1 |
| 4,763,284 | A * | 8/1988 | Carlin | 702/41 |
| 5,281,191 | A * | 1/1994 | DeSousa | 482/83 |
| 5,501,649 | A * | 3/1996 | Queppet | 482/88 |
| 5,899,809 | A * | 5/1999 | Landa Cosio | 463/8 |
| D410,986 | S * | 6/1999 | Luedke et al. | D21/798 |
| 5,971,398 | A * | 10/1999 | Broussard et al. | 273/408 |
| 6,925,851 | B2 * | 8/2005 | Reinbold et al. | 73/12.09 |
| 6,942,585 | B1 * | 9/2005 | Krause | 473/445 |

* cited by examiner

*Primary Examiner* — Glenn Richman

(57) ABSTRACT

A multi-mount heavy bag designed for a single user for striking with the intent of developing and conditioning users muscles and skill with at least one unique sculpted body side having contoured features and developed striking areas with at least one forward extended head like appendage that creates for the user a unique orientation to the bag simulating an opponent: providing a distinct opponent posture and specific exposed set of target areas. A bag that can be suspended from either the top, or mounted to a surface below that will provide multidirectional movement. A device of three embodiments of construction each has an option of a digital data analysis package that consists of appropriate components and software for: data storage, retrieval and or wireless transmission for displaying a visual and auditory measure of the intensity of the strike and providing analysis and comparison of performance data.

7 Claims, 7 Drawing Sheets

50
42
43
44
40
41
48
45

50
10
31
33

48
47
47
46

16
49

33
31

MULTI-MOUNT HEAVY BAG WITH: SCULPTED BODY SIDE, EXTENDED HEAD LIKE APPENDAGE, CONTOURS AND DEVELOPED STRIKING AREAS

CROSS-REFERENCE TO RELATED APPLICATIONS

U.S. Patent Documents

| | | |
|---|---|---|
| 8,029,421 | October 2011 | Commeau |
| 4,770,412 | September 1988 | Wolfe |
| 6,155,960 | December 2000 | Roberts et al. |
| 6,872,171 | March 2005 | Haselrig |
| 4,491,315 | January 1985 | Dye |
| 7,862,485 | January 2011 | Luigi |
| 5,328,425 | July 1994 | Knighton et al. |
| 6,234,940 | May 2001 | Fotsis |
| 20120053016 | March 2012 | Williamson |
| 7,909,749 | March 2011 | Sheedy |
| 7,867,148 | January 2011 | Tsakiris |
| 5,941,801 | August 1999 | D'Alto |
| 7,824,316 | November 2010 | Wang et al. |
| 7,704,194 | April 2010 | Chen |
| 6,726,605 | April 2004 | Chen |
| 7,758,476 | July 2010 | Chu |
| 7,857,729 | December 2010 | Sullivan et al. |
| 6,217,489 | April 2001 | Nicholson |
| 6,827,674 | December 2004 | Ferry |
| 7,993,249 | August 2011 | Fassl et al. |

STATEMENT REGARDING FEDERALLY SPONSORED RESEARCH OR DEVELOPMENT

Not applicable

FIELD OF THE INVENTION

A multi-mount multidirectional movable heavy bag exercise device for striking with the intent of developing and conditioning users muscles and skill with at least one sculpted body side having contoured features, developed target areas having an optional digital data analyses package and force indicator for analysis of performance data.

BACKGROUND OF THE INVENTION

Like all sports equipment people are always striving to improve its training utility and the heavy bag is no exception. One problem is selection of equipment/bag type; the durability of, weight and often the construction of bags built for training for power vary depending upon the skill level of the person using them. The heavy bag is and has historically been an elongated force absorbent cylinder that in its entirety is the target that may be struck anywhere. The existing literature regarding heavy bags can be looked at by dividing it into five basic areas; traditional suspended cylindrical bags, traditional central body as a suspended bag with additions, suspended heavy bags with central cylindrical changes, bag like targets that are not suspended (tower and pedestal bags) and the new concept of the current invention of a multi-mount bag having a sculpted body side.

Another problem the current invention seeks to remedy is the ability to provide a specific orientation for the user and ability to practice attacks on specific on-guard stances. As the existing literature is reviewed it becomes apparent that although there have been modifications to the bags the focus has not been to create an orientation for the user regarding target areas. The term orientation has been used in a context of looking at from a perspective as in how the bag is supported, the areas it is used, or modifications to the bag to accentuate training utility such as adding of appendages to block or modifying a part of the bag such as making a conical shape on it to improve striking ability for various attacks. The current invention has specifically been designed to improve orientation; meaning how the user senses the posture or on guard stance presented on the contoured body side of the bag which simulates an opponent regarding the striking areas and contours which may or may not limit what striking areas are available.

The term multi-mount means that the owner has the option of suspending the bag from an overhead suspension point/mount which will allow for multidirectional movement or affixing the bag from a horizontal mounting surface below the bag that may come from the ground, floor or may be attached to a wall or beam that will also provide multidirectional movement.

Traditional suspended cylindrical bags have been used since the beginning of recorded military history and are usually suspended by chains or ropes for learning and practicing how to throw powerful body punches. This type of bag is clearly identified for example, in U.S. Pat. No. 6,217,489 to Nicholson who patented a method for filling the bag. Similarly, in U.S. Pat. No. 6,827,674 to Ferry the traditional suspended cylindrical bag concept is maintained but Ferry patents involves the insertion into the body of a two-liter soda pop container. U.S. Pat. No. 7,758,476 to Chu provides a modular inflatable cushion design for the interior creation of the traditional suspended cylindrical heavy bag. These patents are similar to many others in this category that have to do with modifications to the interior of the traditional suspended cylindrical bag to gain a specific training advantage of what the bag feels like when struck.

The second category of traditional central body as a suspended bag with additions can be clearly identified for example, in U.S. Pat. No. 5,697,872 to Stronsick, Jr. et al. entitled "Martial Arts Training Device" the normal three dimensional heavy bag is still used only leg and arm like extensions are added to the body of the bag. Similarly, U.S. Pat. No. 8,029,421 to Commeau entitled "Reactive punching bag device" ads to the traditional central body as a suspended bag with additions by including an assembly to simulate arm like extensions. Neither device deviates from the traditional cylindrical body three dimensional suspended bag target concept; like others in this category they use the traditional suspended cylindrical concept and make additions to the exterior. The problem is that the bag needs arms and their answer is to create attachments to the bag unlike the current invention that has the arm contours made integral to the bag, out of the same material, being a substantial component thereof.

The third category, suspended heavy bags with central cylindrical changes are clearly representative in U.S. Pat. No. 4,491,315 to Dye entitled "Training bag for boxing and the like" which still adheres to the three dimensional central body target concept but variations are now made to the central cylinder to create angled surfaces on the spindle or shaft of the central cylindrical body to allow a larger variety of attacks to be properly applied to the target. The problem is providing a proper surface for bent arm punches like the uppercut and hook. By angling surfaces on the bag they do provide an improvement and the entire bag is still the target. The heavy bag now has surfaces for uppercuts and hooks and a distinction of a head like appendage target is added along the "Y" axis. Roberts, et al. in U.S. Pat. No. 4,491,315 takes this concept and adapts it with arm and leg like appendages creating and maintaining the three dimensional suspended cylinder shaped mannequin like target with a separate head like target structure on the central "Y" axis. The mannequin or dummy target arms and legs are constructed to rotate/move when the bag like dummy is struck. The arms and legs hang limp and are moved by momentum and certainly are not made for providing any orientation or semblance of an on-guard-position. Similarly, in U.S. Pat. No. 6,872,171 to Haselrig entitled "Martial arts training bag" the central cylindrical body portion of the bag is still present as a target and modified with a tapered funnel like addition to add variation to the striking surface for various attacks. This is an attempt to improve the striking areas. The current invention advances this idea by developing specific striking areas that are crafted so specific types of attacks can be done and all strikes can be done with proper technique when applied to the proper target. Haselrig adds to the bag attachable/detachable targets as shown in his illustrations as round bags extended from the tubular portion of the bag on a round extension. These are referred to as "head targets" that can be inflatable or stuffed or "in the form of speed bag assemblies utilizing a conventional boxing-type speed bag." By the definition Haselrig puts forth of his head like target I would argue that it certainly is not. Haselrig's head like target is another striking device already in use a "Boxing-type speed bag" that is being extended from the bag. Since it does not truly resemble a head as does the current invention nor does it have developed striking areas on the head like striking area. I would contend that Haselrig did not provide a head like target but a "speed bag" extending forward of the "Y" axis. In the current invention the head like striking area has specific position, orientation and developed striking surfaces upon it and clearly extends forward of the other striking areas and in no way resembles a speed bag. As an improvement in the evolution of the heavy bag Haselrig creates a hybrid device that bridges both the traditional central body as a suspended bag with additions and the heavy bags with central cylindrical changes category by adding existing targets to his.

In the fourth arena of bag like targets that are not suspended there are two basic areas; pedestal or tower bags and bags that are supported from both the floor and the ceiling simultaneously. None provide the option of mounting from one end or the other as the current invention does. The problem is having the ability to have a multi-directional movement bag and use it in various training locations such as outside. The first category of pedestal or tower bags can clearly be identified by U.S. Pat. No. 4,770,412 to Wolfe creates a free standing, self-righting bag with sculptured arms and head that is positioned on the central "Y" axis still using the mannequin like design concept where the central body of the bag is the target as is the norm with punching bags. The arrangement of the arms begins to solve the problem of providing for the user an orientation to the target. However, the arms purpose is not to present a specific orientation regarding target areas or to restrict striking to specific target areas as the current invention does. U.S. Pat. No. 5,941,801 to D'Alto provides another self standing pedestal or tower bag that combines the central body bag concept with the addition of a donut shaped portion of the bag having cylindrical changes. U.S. Pat. No. 7,704,194 to Chen, presents a central cylindrical heavy bag mounted on a post with a spring to allow movement however the post spring component is an integral part of the bag apparatus, meaning the bag is not intended to be used without the stand. It differs from the multi-mount bag in that the post is not removable from the bag. U.S. Pat. No. 7,993,249 to Fassl, et al. provides a large pedestal that holds the traditional cylindrical heavy bag from the top. Heavy bags supported from both the floor and ceiling are represented in the U.S. Pat. No. 7,824,316 to Wang, et al., who creates a cylindrical bag that wraps around a pillar. U.S. Pat. No. 7,867,148 to Tsakiris provides a traditional cylindrical heavy bag on a pole that is affixed to both the floor and the ceiling. U.S. Pat. No. 7,862,485 to Luigi, uses the ceiling and floor mount approach with additions to the traditional cylindrical heavy bag having padded arm attachments that swing unpredictably when the bag is struck based off the inertia of the users strike. All of these previously described targets are designed to be either supported solely from overhead or solely from underneath or from both ends; none provide option for variation of attachment as in the current invention where either one or the other mount point is used as an option thus the multi-mount category. All previous art continues to provide a central cylindrical body for punching without specific development of a developed striking area intended for specific strikes. Some inventors have looked at the problem of identifying a target area on the bag and some bags may have target areas noted on them by printing on the exterior surface, but an intentional shaping of the target area in a heavy bag does not exist except in the current invention.

The inventions that have head like targets are all on the "Y" axis unlike the current invention that extends forward of the "Y" axis. The inventions that have uppercut designed areas maintain the entire target striking area approach so they present a donut shaped or beveled contour area around the entirety of the cylinder like bag as the striking area in an attempt to solve the problem of creating a bag that has uppercut utility. The current invention takes this idea and provides clear specificity in providing a head like appendage that extends toward the user with parts specifically designed for specific attacks such as the hook and uppercut.

The fifth category, the present invention, is novel as a multi-mount heavy bag intended for a single user that can be suspended or attached from above such as being suspended from the ceiling or attached to a floor or wall mount, providing a horizontal mounting surface below the bag that will also provide multidirectional movement. No other heavy bag device either singly or in combination present this unique feature also having: a sculpted body side consisting of defined and developed target areas and contoured features that create a complex target with unique orientation for the user.

Because of the sculpted body side approach the current invention is no longer in the genera with the central body target bags because the entire bag is not the target due to the specified developed striking areas and extended head like appendage.

Additionally, due to the contoured features creating for each side a unique orientation only certain target areas are available for attack.

Furthermore, the current invention is unique because through the positioning of the contours and striking areas specific intended targets may be presented or limited. No other bag limits its striking area.

Additionally, the combination of the position of the contours; be it the arm like contours or the tilt of the head like appendage a multitude of clearly identifiable on-guard poses can be created and represented on a sculpted body side to enhance the variation and training options afforded in a single training heavy bag. This solves the problem of having to visualize application of striking an opponent in a specific position you simply find a bag with the on-guard orientation you need. The sculpted body side is set for a particular face of the bag and cannot be changed. Bags will have set selections of on-guard poses and if a person wants a specific pose they will need to buy that specific bag because there is no intended method of changing or modifying any of the contours or striking areas of a bag.

The construction embodiment is also unique to the multi-mount bag which is not a feature available in any other heavy bag. The multi-mount bag has three embodiments of construction and an option to either have or not have a digital data analyses package. The first multi-mount embodiment of construction is of a hard plastic or composite having attachable force absorbent striking areas creating a heavy bag that can withstand excessive punishment for use with elite or professional fighters. The second embodiment of construction is a foam or rubber or combination thereof, which has utility in training with smaller children or inexperienced fighters. The third embodiment is traditional construction of synthetic or leather outer covering filled with a force absorbent internal stuffing and having a lacing type closure. Some users will want the new features of the multi-mount bag but be more comfortable with a traditional manufactured construction. Each embodiment of construction is intended for the developing and conditioned of user's muscles and skill having at least one unique sculpted body side for a single user.

Lastly, the digital data analyses package is an option available for each of the three embodiments consisting of at least one force sensor and speaker having auditory and visual display and may have a keypad or digital card based method to recognize and identify a specific user for analysis and disaggregation of performance data and to measure the intensity, number and speed of a strike and or combination thereof. The digital data analysis package may store data; count strikes and retain the power data for review, retrieval or transmit it to other devices. The digital data analyses package does not have a game feature nor does it prompt the user to strike a specific area or do so in a pattern that is game like. It does not count caloric burn rate or monitor target heart rate to prompt exertion for heart rate training for the user. The data collection is passive. The digital data analysis package is not intended to do anything other than give immediate audio and visual feedback and provide the ability to retain data for retrieval and assessment. U.S. Pat. Application No. 20,120,053,016 to Williamson is an excellent example of a suspended heavy bag workout monitoring system intended to provide a way to capture, analyze, and monitor user body performance information. Williams's invention uses a traditional suspended heavy bag with color in different areas to distinguish between target areas on the face of the suspended heavy bag. There are a great number of boxing devices for determining user body performance data such as U.S. Pat. No. 7,909,749 to Sheedy that not only captures performance data it computes caloric burn rate unlike the current invention. Although, a shared common ability in design to interface with wireless components like smart phones, tablets and computers is shared in current invention for only one user at a time. Sheedy's invention is a multi-user boxing device also integrally part of a traditional suspended heavy bag unlike the current invention.

SUMMARY OF THE INVENTION

The present invention provides specific benefits due to its embodiments of construction, and unique sculpted body design which gives rise to the objectives of the invention as described below.

The term multi-mount means that the owner has the option of suspending the bag from an overhead mount point like the ceiling from a chain or rope which will allow for multidirectional movement or affixing the bag to a horizontal mounting surface below the bag with a spring action mount that will also provide multidirectional movement. The multi-mount bag has at least one unique sculpted body side that will provide for the user a unique orientation to the target. The orientation on the sculpted body side is achieved through the use of contoured features, and developed striking areas and positioning of the head like appendage to mimic the on guard stances commonly used that limit use of specific types of attacks and provide opportunities for others.

One objective of the present invention is to provide a unique bag with three embodiments of construction is to provide selection regarding the construction of the bag for various skill levels of training having similar features but more durable construction and this is achieved through the three manufacturing embodiments of construction. The first multi-mount embodiment of construction is of a hard material, plastic or composite exterior having attachable force absorbent striking areas creating a heavy bag that can withstand excessive punishment for use with elite or professional fighters. This construction method provides a hollow interior that has a cap type closure and allows the user the ability to fill the bag to a desirable weight with fillers of their choosing, sand, concrete, etc. The second embodiment of construction is a foam or rubber or combination thereof, which has utility in training with smaller children or inexperienced fighters. The prior two embodiments provide for a new method of creation of a heavy bag through modern manufacturing techniques such as rotational casting or injection manufacturing or thermoforming which should reduce prices of heavy bags. The third embodiment is a traditional construction having a synthetic or leather outer covering filled with a force absorbent internal stuffing and having a lacing type closure. Some users will want the new features of the sculpted body side multi-mount bag but be more comfortable with a traditional manufactured construction. Each embodiment of construction is intended for the developing and conditioning of the user's muscles and skill.

Another objective of the present invention is to provide for the user a specific orientation and ability to practice attacks on specific on-guard stances. This is achieved through the various contour positions on each sculpted body side; the positioning of the arm like contours in various on-guard positions or the tilt and position of the head like appendage, or a combination thereof providing a passive target with defined obstacles to consider in choosing and applying appropriate attacks.

Another objective of the present invention is to provide the user a three dimensional target of an opponent in a multi-mount heavy bag where developed striking areas are presented that are crafted so specific types of attacks can be done and all strikes can be done with proper technique when applied to the proper target. No other heavy bag has this specificity of target area and attacking tool association for use of proper technique.

Another objective is to provide a bag with a single or multitude of sculpted body sides on a single multi-mount heavy bag to improve training utility and application of the most common attacks against the most common on-guard positions which purposely restrict access to specific target areas. To achieve this objective and provide options to the person selecting the bag, a bag may have one sculpted body side or multiple sculpted body sides that would let the user pick from a variety of on-guard stances to practice upon. The sculpted body side is created by making slight variations in placement of the contours and the head like appendage.

Another objective of the current invention is to provide padded developed striking areas in a multi-mount heavy bag that are specifically designed for strikes at specific angles so properly delivered attacks will land perpendicular to the striking surface. The striking areas consist of: a head like appendage that extends out from the "Y" axis of the body of the bag having a developed chin-like striking area and developed temple striking area, at least one ribcage like striking area, a stomach like striking area and a groin striking area.

Another objective of the current invention is to provide attachment ability at the top of the bag for hanging or suspension of the bag from an overhead support while allowing multidirectional movement. Also the bag would have attachment ability from the bottom of the bag so the bag could be used from a support coming from under the bag such as a post or pedestal which would have a spring and provide multidirectional movement. The intent is to use either the suspended attachment from the bottom or the top of the bag, not to use each feature simultaneously. This will provide a multi-mount bag that would provides an option of mounting for the user because it is not always convenient or desired to suspend the bag depending upon your training area especially if you are training outdoors. Additionally, the mounting option also has impact on the tip of the multi directional movement. A multi-mount bag on a spring pedestal will have a different swing movement when punched in the head than the same bag would have if in suspension from a ceiling mount. This multi directional swing and tip movement depending on the bag suspension point makes a difference to the application of techniques and attacking movements of the person striking the bag because of how the bag moves.

Another objective of the current invention is to provide for the user a target having option for digital data capture and analysis capability. This feature will include at least one impact sensor and one visual display and one audio speaker to provide instant visual and auditory feedback to the user displaying a measure of the intensity of the strike.

Another objective of the current invention is to provide an option for a digital data analysis package for the user to provide analysis of performance data and monitor exercise parameters meaning the counting of punches, power, speed there of etc. and ability to store and transmit this information to a digital device via wireless, wire or attachment or a thumb drive or data card for transmission or movement of this data to a computer or other digital appliance for data performance assessment and management for longitudinal progress of training performance.

Other advantages of the present invention will become apparent from the following detailed description in conjunction with the accompanying drawings.

BRIEF DESCRIPTION OF THE SEVERAL VIEWS OF THE DRAWING

For the purpose of illustrating the invention, there is shown in the drawings forms which are presently preferred; it being understood, however, that the invention is not limited to the precise arrangements and instrumentalities shown.

DETAILED DESCRIPTION OF THE INVENTION

Figure 1:
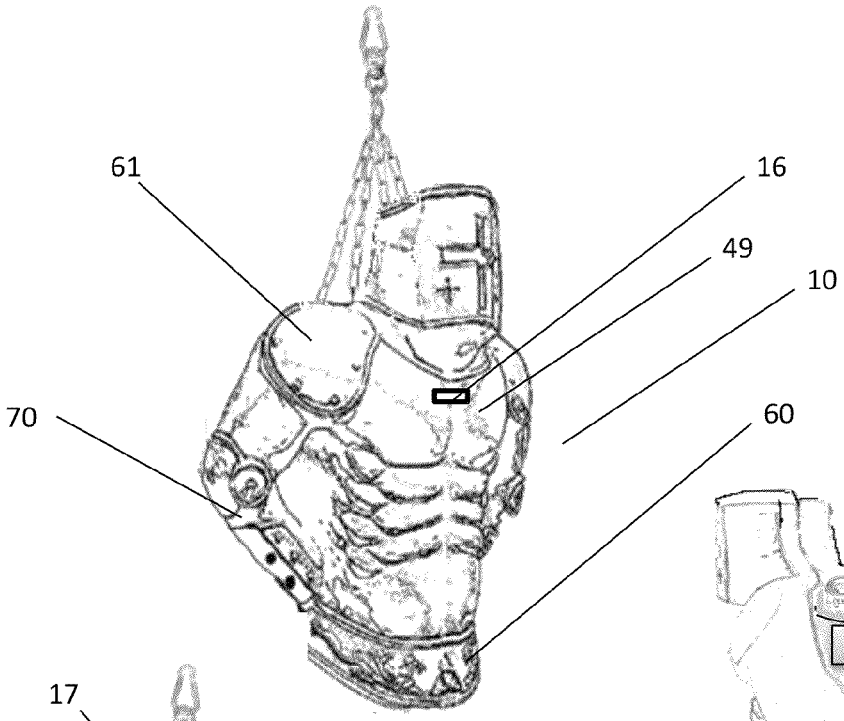
FIG. 1 is a perspective right side view of a multi-mount heavy bag in suspension use the embodiment is one sculpted body side the construction is traditional in that it has a synthetic or leather outer covering with reinforcement padding made of stuffing in the striking areas and has a lacing type closure with digital data analyses package.

The description is not intended to be limiting, it is made solely for the purpose of illustrating the principles of the invention. The striking training aid depicted of the present invention is a device which resembles the torso of an armored knight. The invention could be made to resemble any number of items i.e., space alien, monster, samurai, tough-guy etc. The invention will however, maintain the set construct principles as defined within this document. There are a multitude of embodiments of the invention based on the orientation of the contour features of the sculpted body side and the number of sculpted body sides associated with the particular embodiment of construction of the multi-mount bag. Because of the large variation in orientation of the various contours there are not a set number of sculpted body side embodiments of the invention but a wide range of possibilities. Note that the striking areas and head like appendage and contours are set within a sculpted body side to present a specific orientation for the user and it is not intended that the user may move them to create a new orientation. Depending on the construction embodiment a striking area padding may be removed such as in the Non-traditional hard plastic embodiment only so they can be replaced if worn or damaged.

The multi-mount capability is integral to each bag regardless of construction embodiment. The owner will have to decide if they want to attach an aftermarket chain for suspension ceiling mount or a spring post insert for suspension from the ground. This feature provides a greater range of utility for the user regarding training area use.

There are three construction embodiments. The first is a novel feature for a heavy bag being the Non-traditional construction; meaning it is constructed of hard plastic, steal or a composite having a hollow interior and fill cap having attachable force absorbent striking areas. This embodiment provides for a novel method of construction such as rotational casting or injection molding. The second embodiment of construction is also novel being constructed totally of a foam or rubber or combination thereof having a plastic insert. This embodiment can be constructed by rotational casting or injection molding or a combination thereof. This method of manufacture for the two previous embodiments is unique because it allows new manufacturing methods to be applied to the multi-mount bag which will hopefully help increase ability of use through providing a lower cost to purchase. The third embodiment of construction is traditional construction of synthetic or leather outer covering filled with a force absorbent internal stuffing and having a lacing type closure. This type of construction is manufactured threw the traditional sewing method.

Each embodiment of construction has an optional digital data analysis package. The digital data analysis package will be manufactured into the embodiment of construction being created in the factory and the individual will choose the option combination they desire. The digital data analysis package is not an aftermarket addition. The submitted figures shown are done to sufficiently show these variations and should not be construed as limitations of design.

Referring now to the drawings in detail, where like numerals refer to like parts or elements, there is shown the multi-mount heavy bag with sculpted body sides each depicted as an armored knight for illustration of the concepts as applicable.

FIG. 1 shows a perspective left rear view of a multi-mount heavy bag 10 in suspension mount. This embodiment has one sculpted body side comprising of a shoulder like contour protrusions 61, a chest like contour area 49, arm like contours 70, a belt like band contour 60; and one visual display 16. The construction is traditional in that it has a synthetic or leather outer covering with reinforcement padding made of stuffing in the striking areas with a lace type closure and digital data analysis package.

Figure 2A:
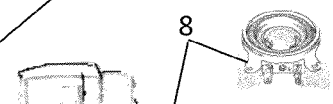
FIG. 2*a* is an expanded view of the internal speaker which is a component within the digital data analysis package.
Figure 2:
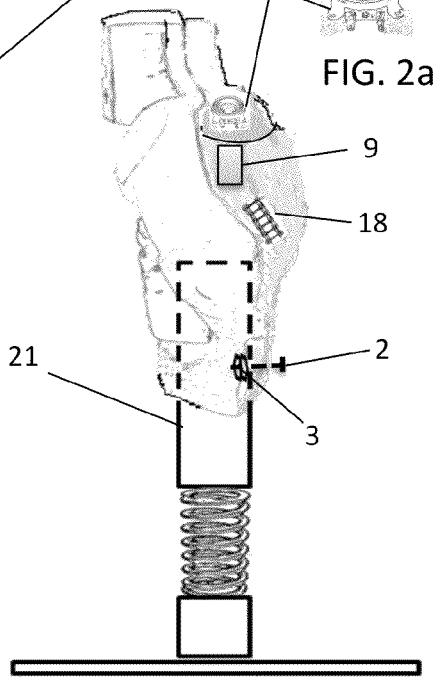
FIG. 2 is a perspective left rear view of a multi-mount heavy bag on a spring pedestal mount, the embodiment is one sculpted body side, the construction is traditional in that it has a synthetic or leather outer covering with reinforcement padding made of stuffing in the striking areas and has a lacing type closure with a digital data analysis package.

FIG. 2 is a perspective left rear view of a multi-mount heavy bag on a spring pedestal mount 21 the embodiment is one sculpted body side the construction is traditional in that it has a synthetic or leather outer covering with reinforcement padding made of stuffing in the striking areas and has a lacing type closure 18. This bag has a digital data analysis package as seen by the access panel 9, which has on the back of it the digital analysis package electronics. The speaker 8, placement is shown although it would be internal to the bag but for illustration purposes is shown for placement. The bolt/draw pin 2 and snap/thread receptacle or nut 3 is shown affixed to the inside of the post to provide secure attachment of the bag to the mounting post.

FIG. 2*a* is an expanded view of the internal speaker 8, which is a component within the digital assessment package.

Figure 3:
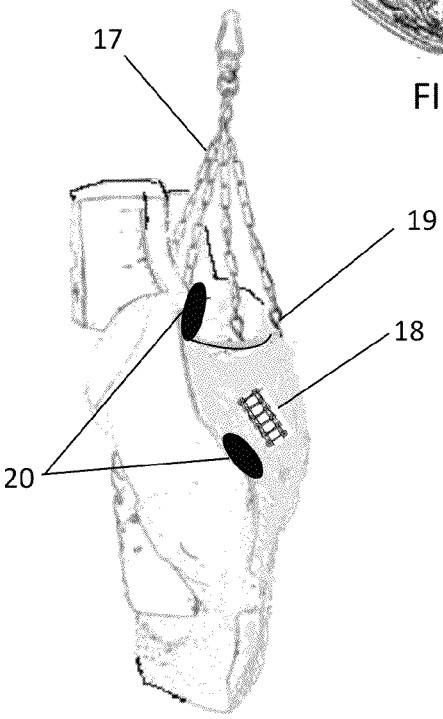
FIG. 3 is a perspective left rear view of a multi-mount heavy bag in suspension mount; the embodiment is one sculpted body side the construction is traditional without a digital data analysis package.

FIG. 3 is a perspective left rear view of a multi-mount heavy bag in suspension use the embodiment is one sculpted body side the construction is traditional in that it has a synthetic or leather outer covering with reinforcement padding made of stuffing in the striking areas and has a lacing type closure method 18, with suspension attachment points 19 on the body of the bag and grasping points 20 to allow a person to easily hold the bag from behind if desired, so a specific sculpted body side can be used. The lacing type closure 18 and suspension chains 17 are also visible. This embodiment does not have a digital data analysis package.

Figures 4, 4A, 4B, 4C, 4D:
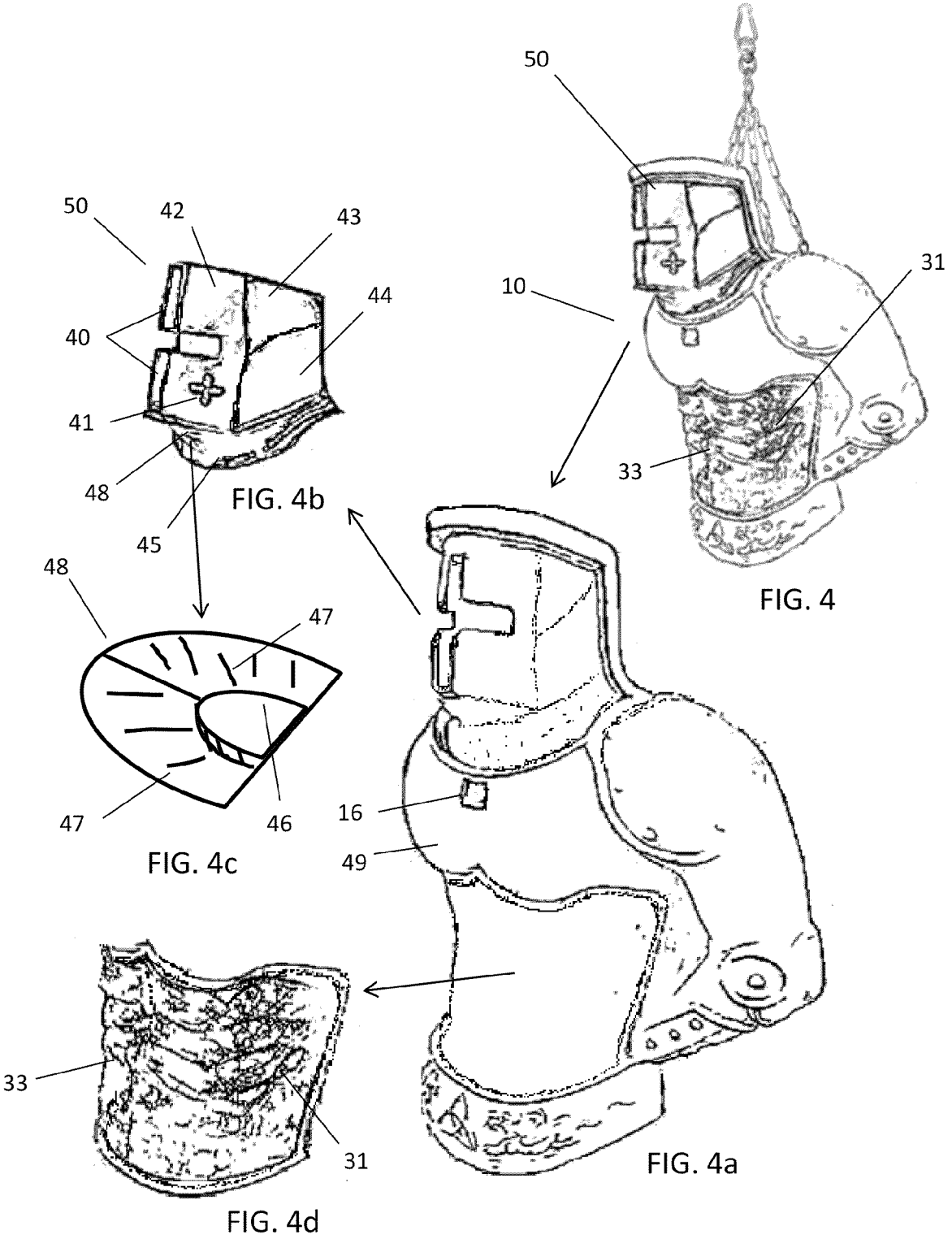
FIG. 4 is a perspective left side view of a multi-mount heavy bag in suspension use the embodiment is one sculpted body side the construction is non-traditional in that it is constructed of hard plastic having attachable padded developed striking areas and this bag is equipped with a digital data analysis package option.
FIG. 4*a* is a perspective left side view of a multi-mount heavy bag in suspension mount the embodiment is one sculpted body side the construction is non-traditional in that it is constructed of hard plastic showing the body of the bag without the attachable padded developed striking areas or the padding for the head like appendage striking area.
FIG. 4*b* is a perspective left side expanded view of the padding of the head like appendage removed from the body of the bag.
FIG. 4*c* is an expanded view of the chin like striking area that is a component part of the head like appendage.
FIG. 4*d* is a perspective left side view consisting of both the developed stomach like striking area and the left side developed ribcage like striking area.

FIG. 4 is a perspective left side view of a multi-mount heavy bag 10, in suspension use the embodiment is one sculpted body side the construction is non-traditional in that it is constructed of hard plastic showing the attachable padded developed striking areas consisting of the extended head like appendage 50, that is set forward of the other XZ axis of the shoulder like contours which is a novel feature of this heavy bag. The left ribcage like developed striking area 31 (32 for the right shown on FIG. 5), and a stomach like developed striking area 33.

FIG. 4*a* is a perspective left side view of a multi-mount heavy bag the embodiment is one sculpted body side the construction is non-traditional in that it is constructed of hard plastic showing the body of the bag having the attachable padded developed striking areas and padded head like appendage striking areas removed. This bag has a digital data analysis package and the insert for the digital display 16 is shown as is the chest like contour 49 which is not an intended striking area.

FIG. 4*b* is a perspective left side view of the padding of the head like appendage striking area 50 removed from the body of the bag. The head like appendage striking area comprises of a front face contoured striking surface 40. The lower jaw 41 and forehead 42, which has one or more faceted faces providing angular relief; and bilateral symmetry having two sides or parallel axis on each side of the head like appendage. Set posterior to the forehead facet is the, temple strike area 43 having a minimum of one facet on each side of the head like appendage striking area as is the same of 44 the back lower portion of the head which is inferior in location on the sagittal plane and posterior of the temple strike area sculpted purposely to resemble striking areas commonly found on humans. Number 45 shows the padded area of the neck and throat. The aforementioned surfaces are designed with intent to receive various types of attacks that are designed specifically such that when the anticipated technique is performed properly (i.e., a hook to the head to 44) the technique will contact the intended target area perpendicular to the striking surface. The head like appendage developed target area 50 comprises of the components 40-48 to include the chin like developed striking area 48 which comprises of components 46 and 47. It is understood that the developed head like appendage striking area 50, is inclusive of all these components.

FIG. 4*c* shows an expanded view the developed chin like striking area 48 of the head like appendage striking area. The chin development has a convex or concave base portion 46, and two extended halves bilaterally (left and right) 47, are flat surfaces with slight outward-upward angle when viewed from the front and extend to provide a robust chin like developed striking area to provide a solid horizontal like shelf that permits uppercuts or kicks appropriate to this contact area.

FIG. 4*d* is a perspective left side view which shows the removed padded portion of the ribcage like developed striking area 31 being the left side developed ribcage (32, the right side developed ribcage striking area is not viewable) and 33 the stomach like developed striking area. Note this is a one piece wrap around design incorporating three distinct striking areas and does not necessarily represent all embodiments or applications of these developed striking areas.

Figure 5:
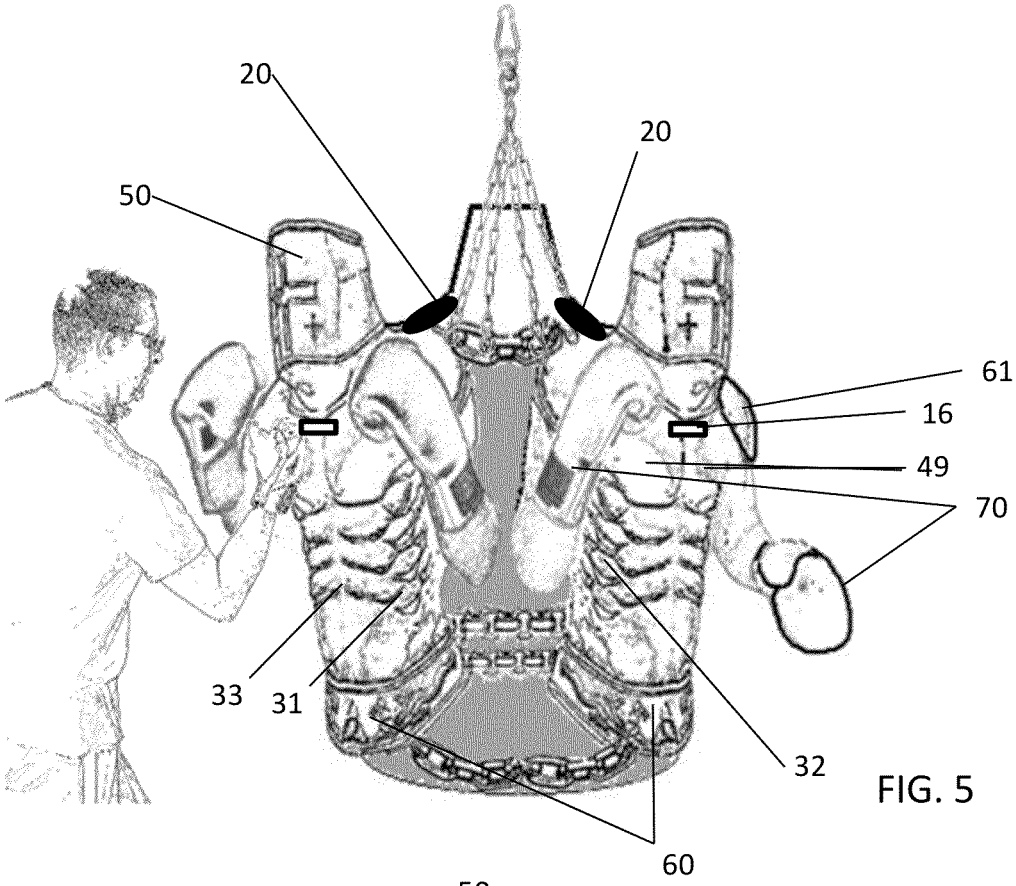
FIG. 5 is a perspective view of a multi-mount heavy bag in suspension mount the embodiment is three sculpted body sides having extended arm like contours, the construction is foam or rubber or combination thereof i.e. a foam core with a rubber exterior with digital data analyses package.

FIG. 5 is a perspective view of a multi-mount heavy bag in suspension mount the embodiment is three sculpted body sides having extended arm like contours the construction is foam or rubber or combination thereof i.e. a foam core with a rubber exterior with digital data analyses package. The stomach like striking area 33 begins at the center line of the contoured side and moves laterally from the center line, similar to the stomach area of a human in that it has a relatively flat front portion, becomes convex and curves toward the posterior of the of the contoured side whereby the target area ends as the curve transitions into the rib cage like striking areas 31 and 32. The most anterior portion of the stomach like striking area transitions into 49 the chest contour that connects to the developed head like appendage striking area 50. The most ventral portion of the stomach like striking area 33 stops at the top of the belt like band 60.

As seen in FIG. 5 the rib cage striking areas 31 and 32 as shown are bilaterally symmetrical and have a pocket effect meaning a concave structure. The rib cage striking area 31 and 32 are defined by their connection with the stomach like striking area 33, and there contact laterally below the shoulder like contours 61 and lower edge of the chest like contour 49 and are framed from the posterior edge by the belt like band 60, and on the anterior edge either terminate at the anterior edge of the sculpted body side or are framed by the arm like contours 70 depending on the arm like contours orientation.

As seen in FIG. 5 based on the positioning of the sculpted body side contours and the head like appendage striking area which may be positioned at various angles presented in conjunction with different arm like contour positions will provide or limit access to developed striking areas for specific techniques. This is a unique feature of the multi-mount heavy bag's sculpted body side design. The development of the striking area is done with intent where the striking area is developed to receive perspective attacks with the proper angle of attack with respect given to the striking surface, so if the attack is performed properly it will land perpendicular to the intended target. Different sculpted body side configurations provide for the user various attack options based on various on guard positions i.e. configuration of the arm like contours and tilt of the head like appendage. The development of the striking area includes: creation of a surface with intent, the surface may be flat or have an angle or a curvature that can be convex or concave which provides a particular angle on the surface to be struck with respect to how the target is displayed, or the creation of facet like faces on the contact area or a combination of the aforementioned which is based on an orientation that is created by the sculpted body side contours which provide a target where specific attacks will land perpendicular to the target areas when proper attacking technique is used which makes the multi-mount heavy bag a unique and desirable training aid.

Figure 6:
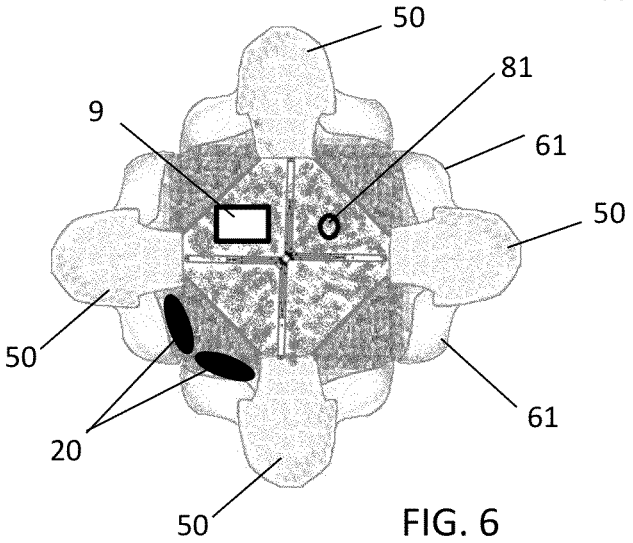
FIG. 6 is a perspective top view of a multi-mount heavy bag with four sculpted body sides without extended arm like contours having a digital data analysis package.

FIG. 6 is a perspective top view of a multi-mount heavy bag with four sculpted body sides without extended arm like contours. The head like appendage developed striking area 50 combined with the shoulder-like contour 61 are labeled to assist in orientation. This particular embodiment of the invention is a non-traditional manufactured of hard plastic with attachable force absorbent developed striking areas and head like appendages. This multi-mount bag has a fill port 81. The fill port allows the owner to fill the interior of the bag with sand or another filler to obtain a desired weight. Also, a top lift electrical access panel 9 which is also the base that holds the electronic board of the digital data analysis package and is the hub for wiring is displayed. This view has two of the grasping points 20 highlighted. There are grasping points behind each shoulder like contour 61.

Figure 7:
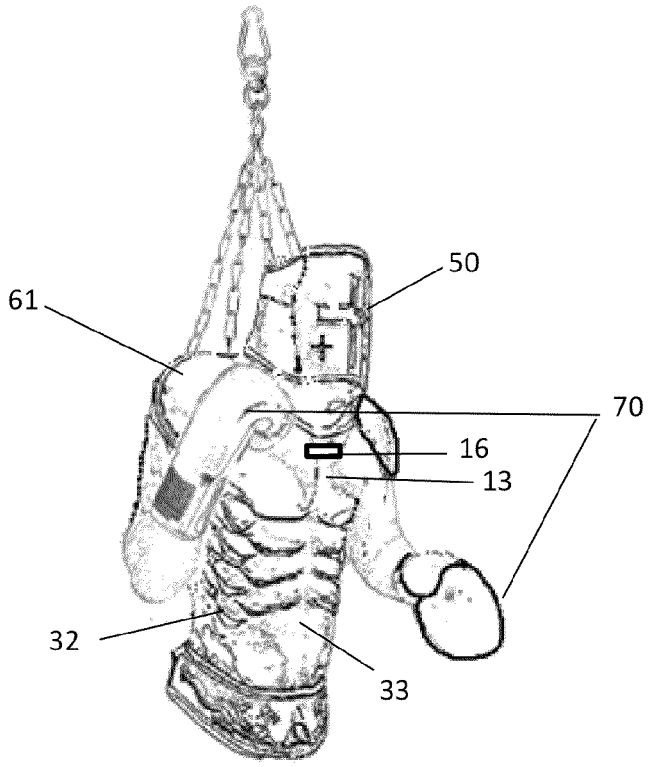
FIG. 7 is a perspective right side view of a multi-mount heavy bag in suspension mount the embodiment is one sculpted body side with extended arm like contours the construction is foam or rubber or a combination thereof with a digital data analysis package.

FIG. 7 is a perspective right side view of a multi-mount heavy bag in suspension mount the embodiment is one sculpted body side with extended arm like contours the construction is foam or rubber or a combination thereof with a digital data analysis package.

As seen in FIG. 7 the chest like contour 49 is below the shoulder like contours 61 and is similar in nature to a male human chest meaning, it has a small flat section that widens towards the distil edges then curves at each side like a normal human chest.

As seen in FIG. 7 the arm like contours 70 may be extended from the face (XZ axis) of the multi-mount bag as opposed to being molded within the sculpted body side. The arm like contours 70 shown in FIG. 7 clearly show the importance of the arm like contours 70 in providing orientation for striking. Because of the placement of the arm like contours in this embodiment the stomach like striking area 33 and the right ribcage like striking area 32 is exposed for a strike where the left arm like contour is limiting an attack to the left ribcage like striking area 31 not shown because of the angle and the left side arm contour is blocking it.

Figure 7A:
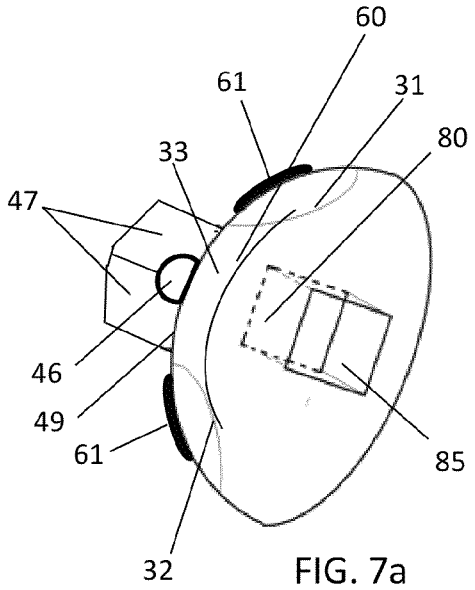
FIG. 7*a* is a perspective posterior view of a multi-mount heavy bag the embodiment is one sculpted body side the construction is foam or rubber or a combination thereof without a digital data analysis package. The view shows the post mount point allowing for horizontal support from the ground.

FIG. 7*a* is a perspective posterior view of a multi-mount heavy bag the embodiment is one sculpted body side the construction foam or rubber or a combination thereof without a digital data analysis package. The view shows the post mount point 85 allowing for horizontal support from the ground. Additionally, the concave feature of the left 31 and right 32 rib cage like striking areas are clearly seen and from this view it is easily seen that the chin like striking area consisting of 46 and 47 extend forward of the XZ axis of the chest like contour 49 and extend forward of the stomach like striking area 33. The lower edge of the belt like band 60 is labeled and the groin striking area identified. The groin striking area is below the belt like band and forward of the post mount point. It is convex in design. It is not intended that the architecture of the groin striking area would present anatomical correctness to the sculpted body side but simply provide a groin striking area of convex curvature to be padded to provide an appropriate striking area.

Figure 8:
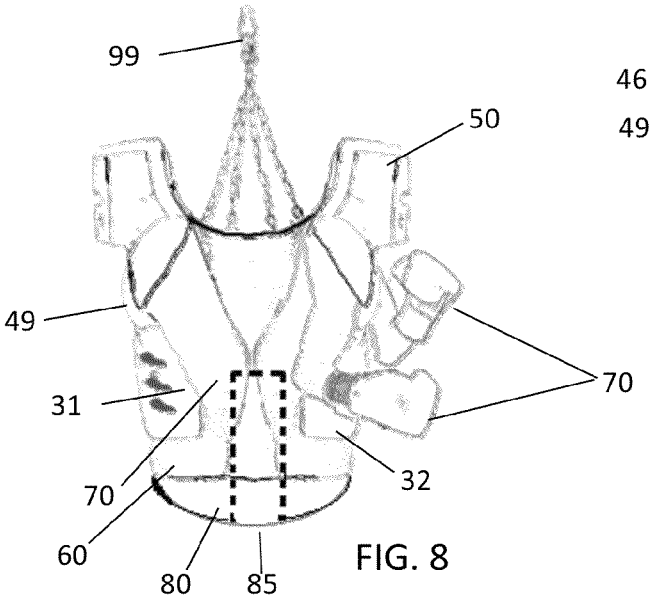
FIG. 8 is a perspective side view of a multi-mount heavy bag in suspension mount the embodiment is two sculpted body sides having one sided with extended arm like contours and one side without extended arm like contours the construction is foam or rubber or a combination thereof without a digital data analysis package.

FIG. 8 is a perspective side view of a multi-mount heavy bag in suspension mount the embodiment is two sculpted body sides having one sided with extended arm like contours 70 and one side without extended arm like contours 70, the construction is of foam or rubber or a combination thereof without a digital data analysis package.

As seen in FIG. 8 the head like appendage striking area 50 due to its position extending forward of the bag may or may not be tilted and is a key point of reference to assist in orientation and work in conjunction with the positioning of the contours to provide a unique orientation for that sculpted body side. Additionally, the positioning of the head like appendage and or contours may limit or expose a striking area. In this example the sculpted body side on the right in FIG. 8 has limited exposure of the lower right side of the head like appendage target area. Meaning an attack to the convex or concave base portion 46, or the left portion of the chin like striking area has limited access from the right side (as viewed from the attacker's perspective) due to the position of the head like appendage striking area 50 and extended arm contour 70.

As shown in FIG. 8 the head like appendage striking area in the current invention is unique in that it extends forward from the XZ axis of the chest like contour 49 toward the user unlike other heavy bags where all head like targets are always on the Y axis. Note in the current invention the chain overhead attachment point 99 is on the "Y" axis of the bag and the head like appendage striking area extend well forward toward the user which is a desirable feature of the multi-mount bag because often an opponent's head is forward of the Y axis.

As shown in FIG. 8 the post insertion point 85 is not used while the multi-mount bag is in suspension mount. Point 80 is a groin strike area below the belt like band contour 60.

Figure 9:
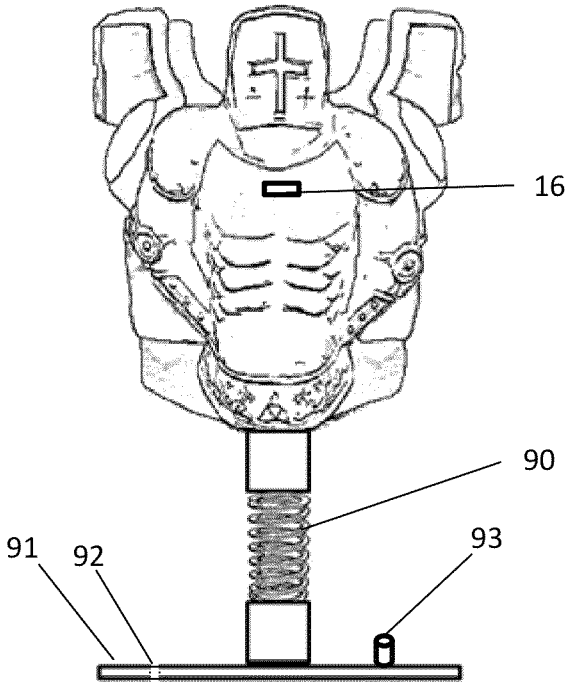
FIG. 9 is a perspective view of a multi-mount heavy bag on a spring pedestal mount that allows multi-directional movement and horizontal support, the embodiment is three sculpted body sides without extended arm like contours the construction is non-traditional meaning it is made of hard plastic with attachable striking areas. This bag is equipped with a digital data analysis package.

FIG. 9 is a perspective view of a multi-mount heavy bag on a spring pedestal mount that allows multi-directional movement and horizontal support, the embodiment is three sculpted body sides without extended arm like contours the construction is non-traditional. The floor mount holder could have a number of different configurations. In this case the mount is a floor pedestal having a spring 90, and floor platform 91 with mounting hole(s) 92 for a bolt attachment to the floor or 93 weight post(s) so weights can be placed on the floor platform 91 and no drilling of the floor would be required to hold the bag in place. The bag has a digital data analysis package as evidenced by 16 the digital display.

Figure 10:
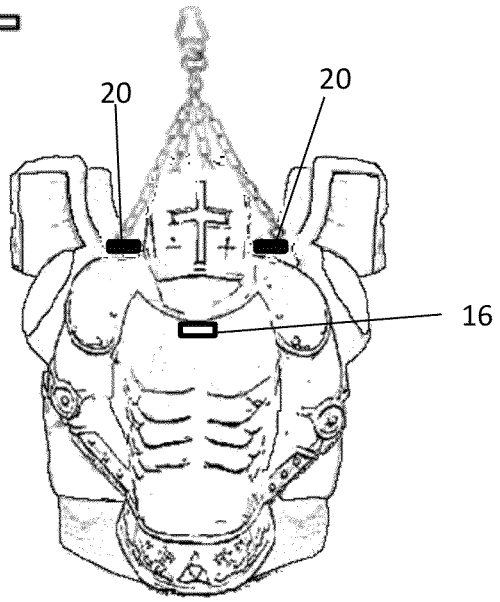
FIG. 10 is a perspective view of a multi-mount heavy bag in suspension mount the embodiment is three sculpted body sides without extended arm like contours the construction is non-traditional and it does have a digital analysis package. It is the same embodiment as FIG. 9 only in suspension mount.

FIG. 10 is a perspective view of a multi-mount heavy bag in suspension mount the embodiment is three sculpted body sides without extended arm like contours the construction is non-traditional, the exact same bag as in FIG. 9 only suspended.

As seen in FIG. 10 the grasping points 20 are located behind the shoulder like protrusions of the sculpted body side. The grasping points being off the top edge allows the bag to be controlled by a coach so a particular sculpted body side can be held toward the user when the bag is in suspension mount.

Figure 11:
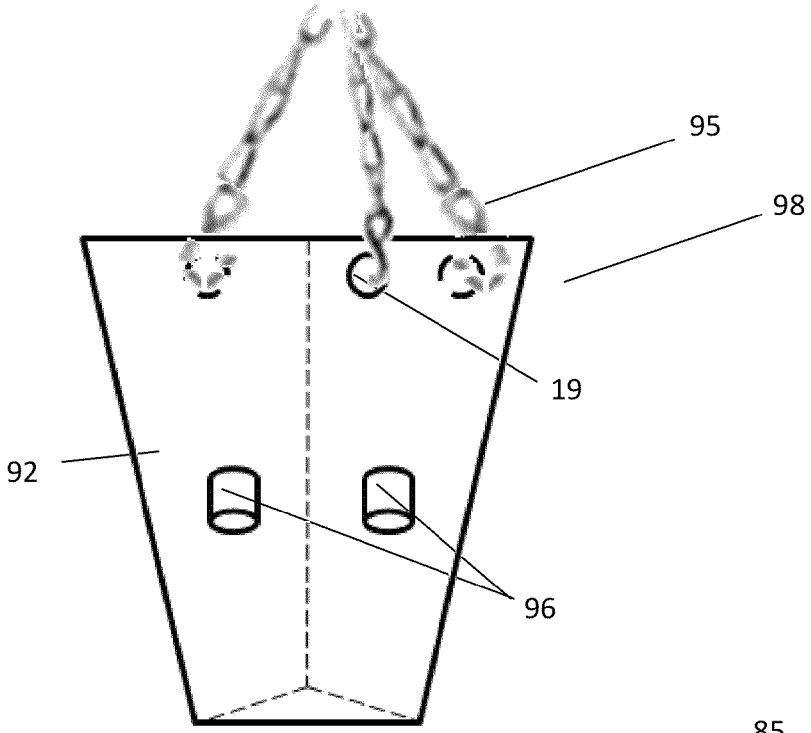
FIG. 11 is a perspective view of a plastic insert for a foam or rubber or combination thereof construction multi-mount heavy bag which provides mounting points for the support chains so the bag can be used in a suspension mount. The insert has three sides so it would be used for the three sided embodiment having three sculpted body sides. The plastic insert provides a mounting point for the accelerometers or force measuring devices and stability for the post insert.

FIG. 11 is a perspective view of a plastic insert 98, for a multi-mount heavy bag used exclusively for the foam or rubber or a combination thereof constructed embodiment and allows for suspension attachment points 19, that a rope or chain hooks 95, can be affixed to so the bag can be used in the suspension mode. The plastic insert also has mounting places 96 for attachment of the force monitoring devices for the body of the bag should the foam or rubber or combination thereof bag also have a digital assessment package.

Figure 12:
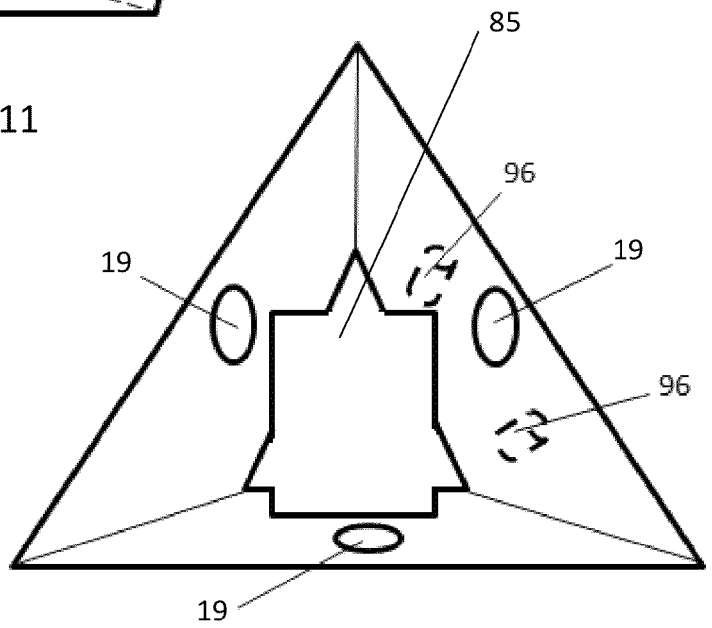
FIG. 12 is a perspective top view of a plastic insert for a multi-mount heavy bag for mounting points for the support chains so the bag can be supported and used in a suspension mount. The embodiment is three sculpted body sides. The plastic insert also provides a mounting point for the accelerometers or force measuring devices. A plastic mount support would be required when the construction is foam or rubber or a combination thereof.

FIG. 12 is a perspective top view of a plastic insert for a multi-mount heavy bag having suspension attachment points 19, for the support chains so the bag can be supported and used in a suspension mount. The embodiment is three sculpted body sides, if the plastic insert was for a bag having two sculpted body sides it would have two sides, if it were for a four sculpted body side bag it would have four sides and so forth. The plastic insert also provides a mounting point 96 for the accelerometers or force measuring devices. A plastic mount support would be required when the construction is manufactured of foam or rubber or a combination thereof. Point 85, the post insertion point shows that the plastic insert is molded such to act as a support for a post should this option be used.

Figure 13:
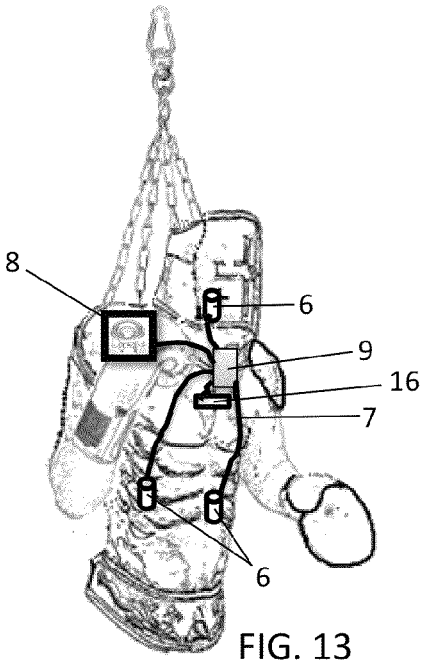
FIG. 13 is a perspective right side view of a multi-mount heavy bag in suspension use the embodiment is one sculpted body side the construction is traditional in that it has a synthetic or leather outer covering with reinforcement padding made of stuffing in the striking areas and has a lacing type closure. The view shows the internal wiring and components of the digital data analysis package.

FIG. 13 is a perspective right side view of a multi-mount heavy bag in suspension use the embodiment is one sculpted body side the construction is traditional in that it has a synthetic or leather outer covering with reinforcement padding made of stuffing in the striking areas and has a lacing type closure. The view shows the internal wiring and components of the digital data analysis package which will be essentially the same despite the construction type when the digital data analysis package is used. Within FIG. 13 the speaker 8, access panel 9 which has on the back of it the digital assessment package electronics, digital display 16, accelerometers or force measuring devices 6, and wire 7 that connect these components are shown.

Figure 14:
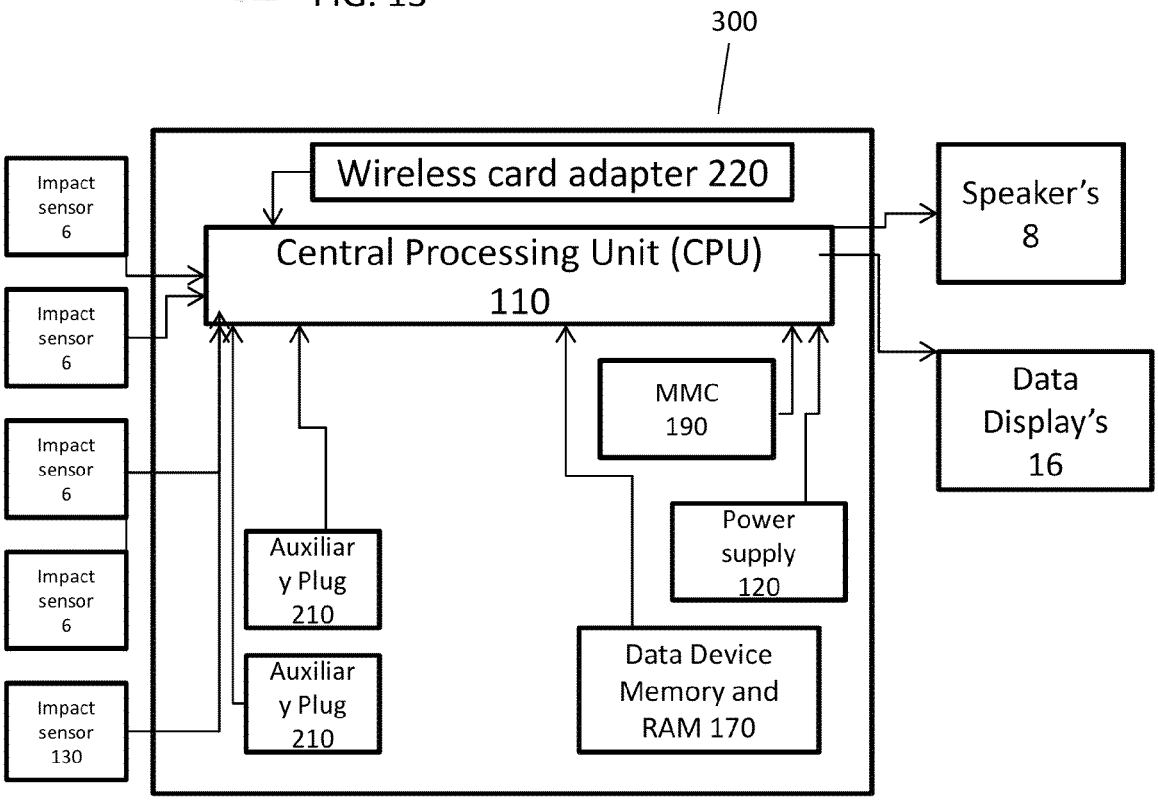
FIG. 14 is a diagram of the electronic board of the digital data analysis package which is on the back side of the access panel.

FIG. 14 is a diagram of the electronic board of the digital data analysis package 300, which is on the back side of the access panel and shows the electronic components diagram for the central processing unit (CPU) 110 communicates with: multiple digital impact sensors 6, speaker system 8, data display 16, the wireless card adapter 220 to support transmission of data for use in other electronic devices, Auxiliary Y plugs 210 which will provide multiple plug in options such as input jacks or a flash card port, data device memory, "USB" (universal serial bus) plug in options and RAM 170 and internal power supply 120 which can include a 120-volt power supply (AC/DC converter or a self-contained battery pack) and "MMC" (multimedia card) 190. The electronic components are such to allow identification of an individual electronically, capture data and allow said data to be transmitted in a number of methods to various electronic devices for disaggregation and management.

Having multiple embodiments of the multi-mount heavy bag allows instructors and coaches to provide a heavy bag in line with their training purpose; no other bag provides the combination of embodiments of construction with sculpted body side, mounting or data analysis capabilities. Additionally, a bag that is suspended has a different quality of multi directional movement than does a bag that is mounted to a structure from underneath it such as a spring mount post. This versatility is an advantage of this design unique to its construction. This feature is also desirable based on some facilities not wanting instructors or coaches to mount things to the wall but do not mind the use of floor stand bags.

The multitude of contour configurations in each sculpted body side also provides a new option for heavy bags.

The intent of the digital data analysis package is to provide a means for digital communication (wire and wireless transmission) and said usage of the data by a program that will allow use of the data to be used by the individual to look at for power development the tempo of strikes, speed and combinations thereof and to compare data of a sequence of personal workouts and or compare data to that of other individuals on line.

It should be apparent that the multi-mount heavy bag described hereinabove, possesses each of the attributes set forth in the aforementioned text. Some attributes can be modified to some extent without departing from the principles as outlined and explained in this specification. It should be understood that the present invention encompasses all such modifications as are within the spirit and scope of the aforementioned claims, summary and detailed description.

What is claimed is:

1. A multi-mount heavy bag of three embodiments of construction: hard plastic or composite, foam or rubber or a combination thereof, traditional having a synthetic or leather outer covering filled with a force absorbent internal stuffing and having a lacing type closure manufactured for striking with the intent of developing and conditioning users muscles and skill; and having at least one unique sculpted body side comprising of:

contoured features having: shoulder like protrusions, a chest like contour area, at least one arm like contour, a belt like band; and multiple developed striking areas consisting of at least one ribcage like developed striking area a stomach like developed striking area a groin striking area; and at least one extended head like appendage; and a digital data analyses package having specific electrical feature of at least one impact sensor, at least one data display for displaying a measure of the intensity of the strike and providing the power of the impact to the user, and at least one speaker for audio that corresponds with the power of the strike; and key pad or digital card reader for identifying the user; and software for data storage, retrieval and or wireless transmission for analysis and disaggregation of performance data; and at least one attachment point at the top of the bag for hanging which can be the sole support providing multidirectional movement; and at least one post mount point at the bottom of the bag providing a horizontal mounting surface below the bag to allow the bag to be used solely by support of a lower support while providing multidirectional movement; and at least one bolt to act as a draw pin that would extend through a portion of the body of the bag having been reinforced appropriately, having a snap fitting or a threaded means on the interior of the post to securely affix the multi-mount body of the bag to the post mount; and at least one grasping point per each sculpted body side.

2. A multi-mount heavy bag as in claim 1 wherein the bag is comprised of a soft force absorbent material: foam, rubber, or silicone foam or a combination thereof, with a plastic insert within the body of the bag for attachment of the chains for overhead suspension and as reinforcement for the post mount option manufactured for striking with the intent of developing and conditioned users muscles and skill.

3. A multi-mount heavy bag as in claim 1 constructed of a hard plastic, steal, composite or other hard material designed for attachment of exterior padding to the developed striking areas and extended head like appendage.

4. A multi-mount heavy bag as in claim 1 wherein the bag sides create a defined closed chamber therein for receiving insert materials therein being padding, sand, foam or other such material having a closure method of a cap if the body is constructed of a hard substance or a method of lacing for closure if comprised of natural or synthetic fabric as found with traditional suspended heavy bags.

5. A multi-mount heavy bag as in claim 1 wherein each sculpted body side of the multi-mount heavy bag presents:

A head like appendage extending forward of the Y axis and forward of sculpted body side XZ axis, having a developed chin like striking surface and developed temple like striking surface, and At least one shoulder like contoured feature(s) each being relative in position to the normal shoulder arrangement found in humans being anterior of the chest like contour and distal from the longitudinal axis of the torso; and a chest like contoured feature that spans the frontal plane bisected by the longitudinal axis of the torso face that assists in defining the separation between the head like appendage and other components of the bag extending distally from the distal edge of the head like appendage to the anterior edge of the stomach like striking area; and a contoured stomach like striking area that is convex having bilateral symmetry and a center line congruent with the head like appendage centerline that extends distally to the top of the belt like band; and at least one ribcage like developed striking areas that horizontally begin at the distill edges of the stomach striking area to the distal edge of the torso face that also extends vertically from the bottom edges of the shoulder like protrusions distally to the belt like band; and at least one arm like contoured feature(s) that extend(s) from the distal edges of the shoulder like contours; formed to represent a multitude of positions for a particular sculpted body side, each sculpted body side having different arm contour configurations to represent different on-guard positions commonly found in fighting; and a belt like band feature that creates a clear separation between the bottom of the bag and the upper torso portion of the bag.

6. A multi-mount heavy bag for boxing and other fighting arts having one or more developed striking areas which is an area that is crafted for a specific type of attack having a specific attack angle so that when properly struck will provide a surface that is perpendicular to the attack being applied; and the developed striking area is created of force absorbent cell foam, rubber or a combination thereof that is affixed to the outside of the bag if the method of construction is hard plastic or composite; and when the construction is of foam or rubber or a combination thereof with a plastic insert within the body the developed striking areas will be integral within the sculpted body side; and when the construction is traditional having a synthetic or leather outer covering filled with a force absorbent internal stuffing and having a lacing type closure the developed striking areas will be integral within the sculpted body side; and the developed striking areas consisting of:

a head like appendage that extends out from the y axis of the body of the bag, extending forward of the XZ axis of the shoulder like contours; and the head like appendage can also be oriented in a multitude of positions similar to a contour but unlike the contoured the head like appendage is specifically developed to be struck; and the head like appendage has at least one chin-like striking area similar in location to a human chin specifically presenting a "Y" axis striking area and at least one temple like striking area; and at least one ribcage like striking area is presented that horizontally begins at the distill edges of the chest like contour extending to the edge of the sculpted body side providing a concave striking area that also extends vertically from the bottom edges of the shoulder like protrusions distally to the anterior portion of the belt like band; and a stomach like striking area is presented below the chest like contour that is domed in shape, bilaterally symmetrical and extends from the distal edged of the chest like contour to the anterior edge of the belt like band; and at least one groin striking area for each sculpted body side between the distal edge of the belt like band and the post insert point creating a convex curvature creating a target specifically designed for kicks and low blows to the groin.

7. A multi-mount heavy bag for fighting arts that has contoured features that creates for the user a unique orientation to the bag simulating an opponent providing a distinct opponent posture and specific exposed set of striking/target areas which are important when constructing attacks based on the opponents posture and ability to apply punch placement on the sculpted body side; additionally, contoured features inhibit access to a striking area or require the user to reposition, as such these contoured features are a unique integral part of the sculpted body side of the bag, which are formed as contours within and on the sculpted body side and extend from the sculpted body side toward the user whereby assisting in the user's orientation ability to assess appropriate techniques and for striking developed striking areas consisting of:

at least one head like appendage; and at least one shoulder like protrusion contoured feature that spans the frontal plane bisected by the longitudinal axis of the torso face that assists in defining the separation between the head like appendage and other portions of the bag; and a chest like contoured feature extending distally from the distal edge of the shoulder like protrusions to the anterior edge of the stomach striking area; and at least one arm like contour feature that extend from the distal edge of the shoulder like protrusions; formed to contour in a multitude of offensive and defensive positions depending upon the sculpted body side, each side presenting different arm contour configurations to represent different arm positions found in various commonly used on-guard-stances found in various fighting arts; and a belt like band contoured feature that creates a clear separation between the groin striking area and the upper torso portion of the bag.

* * * * *